US005868689A

United States Patent [19]

Faroky et al.

[11] Patent Number: 5,868,689

[45] Date of Patent: Feb. 9, 1999

[54] HAND HELD MASSAGE DEVICE WITH RESILIENT BALL ON FLEXIBLE CORD BETWEEN TWO HANDLES

[76] Inventors: Sherri Faroky, 1258 Brockton Ave. #203, Los Angeles, Calif. 90025; Jim Allen, 2701 Voorhees Ave. #5, Redondo Beach, Calif. 90278

[21] Appl. No.: 905,677

[22] Filed: Aug. 4, 1997

[51] Int. Cl.[6] ..... A61H 15/00

[52] U.S. Cl. ..... 601/120; 601/131; 601/132; 601/124; 601/143

[58] Field of Search ..... 601/118–121, 129, 601/131, 132, 135, 143, 125, 124

[56] References Cited

U.S. PATENT DOCUMENTS

| | | | |
|---|---|---|---|
| 932,780 | 8/1909 | Hero | 601/132 |
| 1,233,537 | 7/1917 | Ahlman | 601/135 |
| 2,305,982 | 12/1942 | Morando | 601/120 |
| 2,688,960 | 9/1954 | Fischer et al. | 601/132 |
| 3,996,929 | 12/1976 | Mabuchi | 601/124 |
| 5,531,665 | 7/1996 | Chen | 601/132 |

FOREIGN PATENT DOCUMENTS

| | | | |
|---|---|---|---|
| 337858 | 7/1921 | Germany | 601/143 |
| 26682 | 11/1912 | United Kingdom | 601/132 |
| 91013605 | 9/1991 | WIPO | 601/118 |

*Primary Examiner*—Danton D. DeMille

[57] ABSTRACT

A hand held massaging device comprised of a first and second handle, a cord perminantly fixed to the first handle and slidably fixed to the second handle. A resilient rubber ball having a hole axially through the center allowing the ball to be mounted on the cord between the two handles. Each handle and the ball have ball bearings where the cord passes through so that the ball can roll easily over the body part being massaged. A pair of snug fitting O rings hold the ball in place but the ball can be moved by rolling the O rings to a new position along the cord. A retaining ring assembly located on the cord just outside the slidable handle acts to retain the slidable handle in the desired position along the cord. In this way a user can space the handles and ball to the ideal location and can hold onto the handles and roll the massage ball over the desired body part in an easy way. The user can increase the effect of the massage ball by leaning his or her body weight against the ball and sandwiching the ball between the body part being massaged and a fixed surface such as a chair back, wall or floor. The hand held massage device of the present invention can also be used as a streaching type exercise device and can also be used as a jump rope.

3 Claims, 7 Drawing Sheets

HAND HELD MASSAGE DEVICE WITH RESILIENT BALL ON FLEXIBLE CORD BETWEEN TWO HANDLES

FIELD OF THE INVENTION

The present invention relates to massaging devices and more specifically to a hand held massaging device.

BACKGROUND OF THE INVENTION

Massaging devices for increasing blood circulation and stimulating the skin and underlying tissue are well known. Hand held massaging devices are on the market today which provide a stimulating effect by rolling a textured cylindrical or other shaped member along the area to be massaged such as an arm or leg. Generally to get the most benefit out of the existing massagers it is necessary for a second person to use the device on the person being massaged especially if the area being massaged is relatively inaccessible to the person being massaged such as the persons back. Therefore existing hand held massagers are much less effective if there is no second person giving the massage and an individual wants to give him or herself a massage. Existing hand held massage devices also do not allow the user to easily apply any more pressure than he or she can exert with arm muscles which in some cases may be insufficient to stimulate deep tissue below the skin.

OBJECTS AND SUMMARY OF THE PRESENT INVENTION

The object of the present invention is to remedy the above mentioned limitations of existing hand held massage devices by providing a new and unique hand held massaging device which can be used to massage a wide variety of parts of the body including the back. The present invention also allows a user to trap the massaging member between himself and a chair back, wall or floor thereby providing an additional deep tissue massaging effect because the user can exert extra pressure by leaning on and rolling over the massaging member. The present invention also continues to provide the benefits of existing hand held massagers.

The present invention accomplishes these and other objects by providing a pair of handles each having a hollow shaft and ball bearings at the end of the handle through which a flexible yet resilient cord enters and exits. One handle is longitudinally fixed with respect to the cord but the second handle can slide on the cord so that the amount of cord between the handles can be from zero to approximately ten feet. A hard solid rubber bail having a hollow shaft penetrating through its center and also possessing ball bearings at either end of the hollow shaft is positioned on the cord between the two handles. The ball is slidable so that it can be made to be located at any spot along the resilient cord. The user can select various massaging modes depending on the body part to be massaged. He or she can have the handles located relatively close together with the rubber massage ball trapped in-between for massaging areas such as the thighs or calves, or the handles can be spread and the ball centrally positioned so that the user can massage the shoulders, neck, foot or other portion of the body where a distance between the massage head and the gripping handles proves more comfortable and efficacious. By sandwiching the massage ball between the body part to be massaged and a surface such as a chair back or wall, the user can increase the penetrating effect of the self massage because of the added body weight and leverage that can be applied by the user. The handles may be spread to allow the user to apply opposing pulling pressure thereby exercising the aims and shoulders. Additionally, the handles may be spread to their maximum position so that the present invention may be used as a conventional jump rope. The ball bearings in the handles keep the cord from becoming twisted.

GENERAL DESCRIPTION OF THE DRAWINGS

DETAILED DESCRIPTION OF THE DRAWINGS

Figure 1:
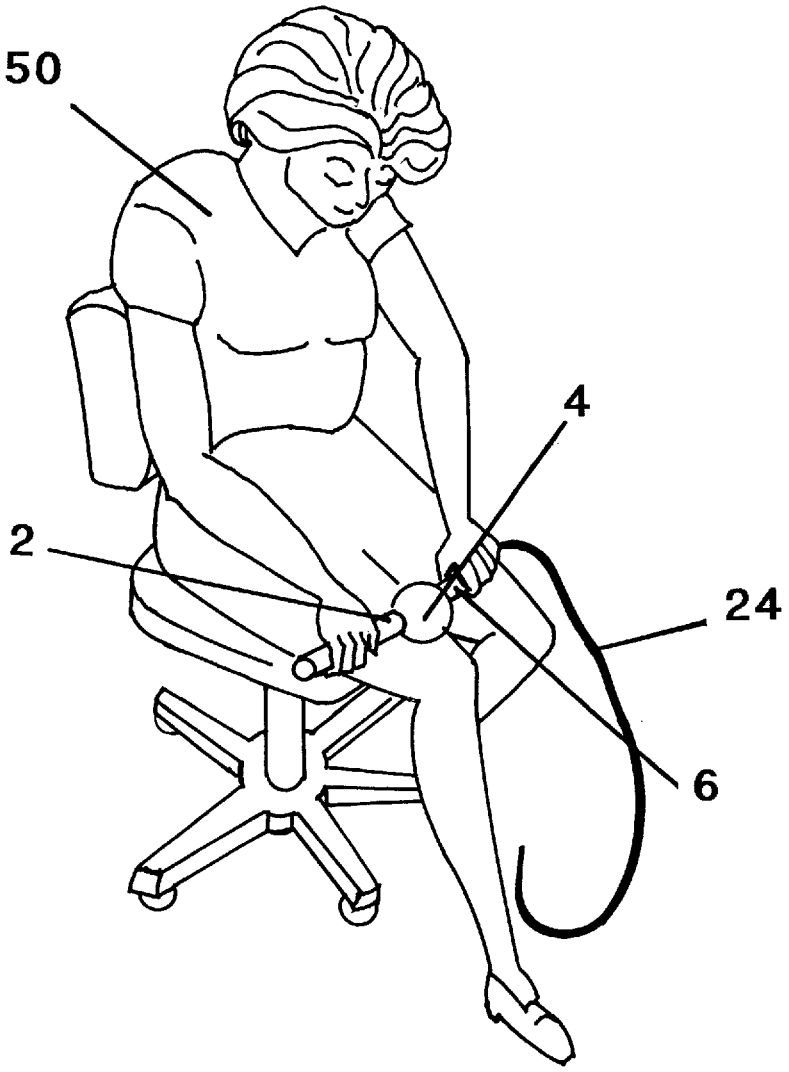
FIG. 1 is a perspective view of a person massaging her thigh.
Figure 2:
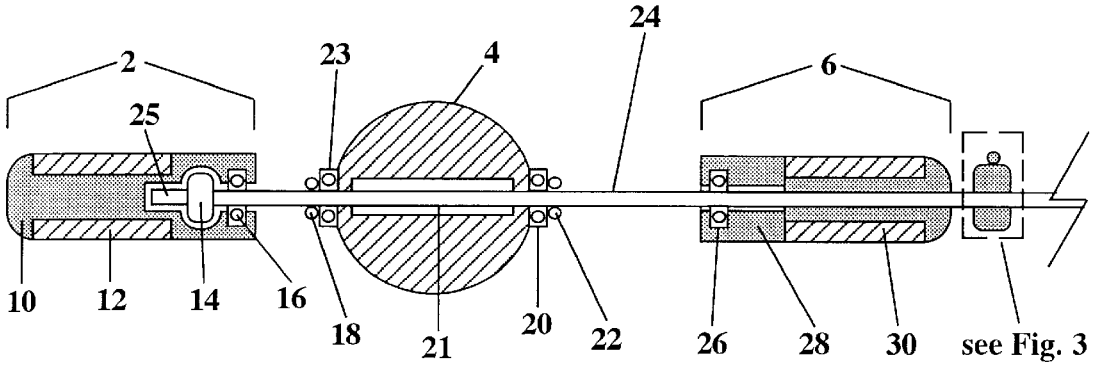
FIG. 2 is a side section view of the hand held massaging device of the present invention.
Figure 3:
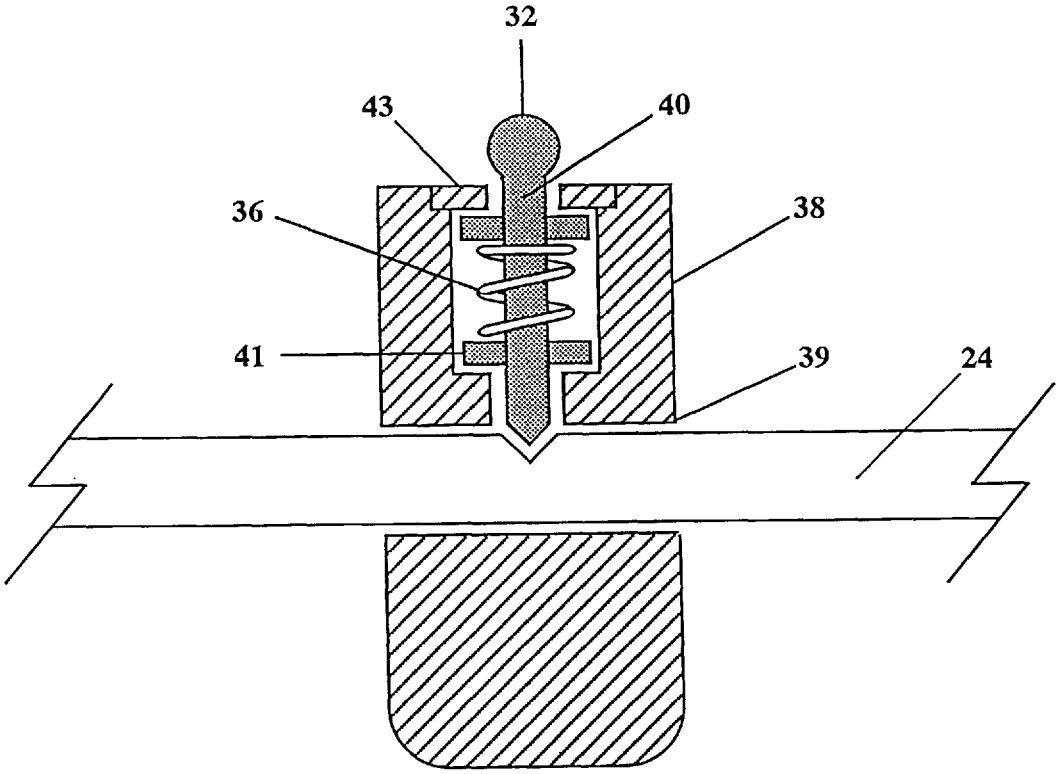
FIG. 3 is a section view of the retaining ring.
Figure 4:
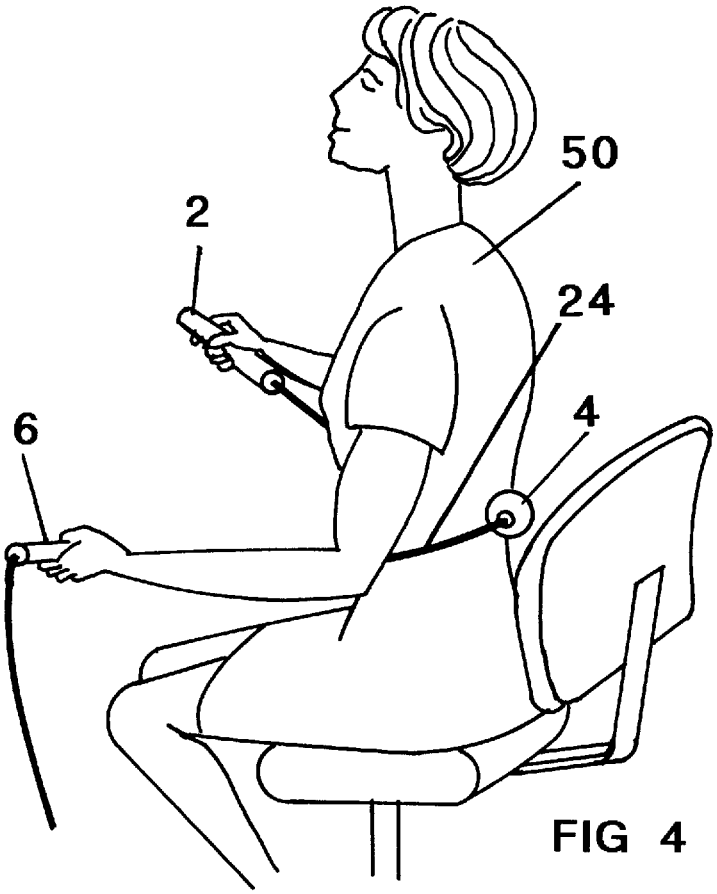
FIG. 4 is a perspective view of a person massaging her back with the present invention.
Figure 5:
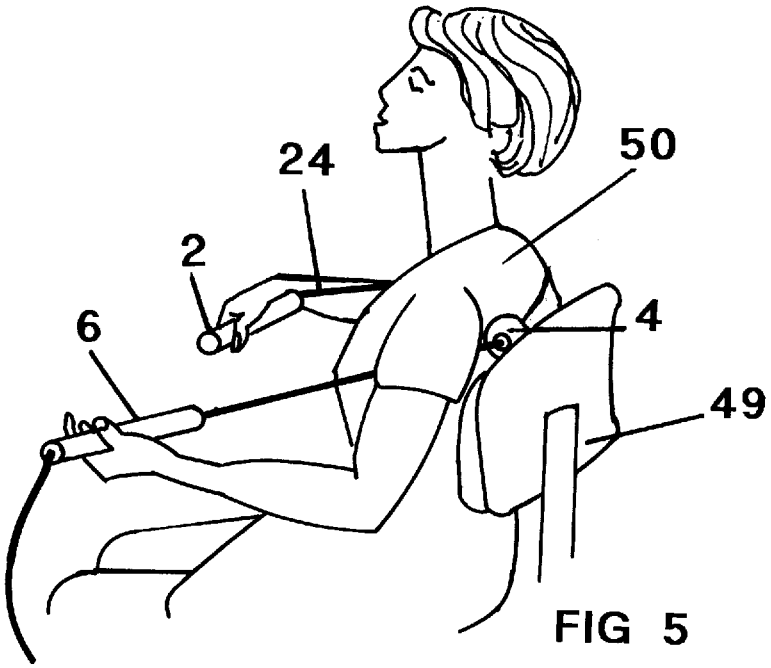
FIG. 5 is a perspective view of a person massaging her back while leaning against a chair back with the present invention.
Figure 6:
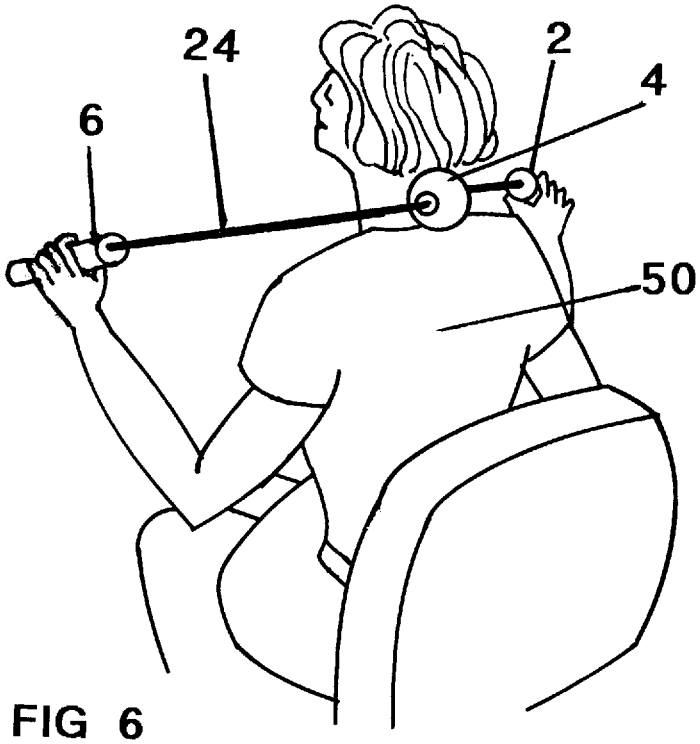
FIG. 6 is a perspective view of a person massaging her neck using the present invention.
Figure 7:
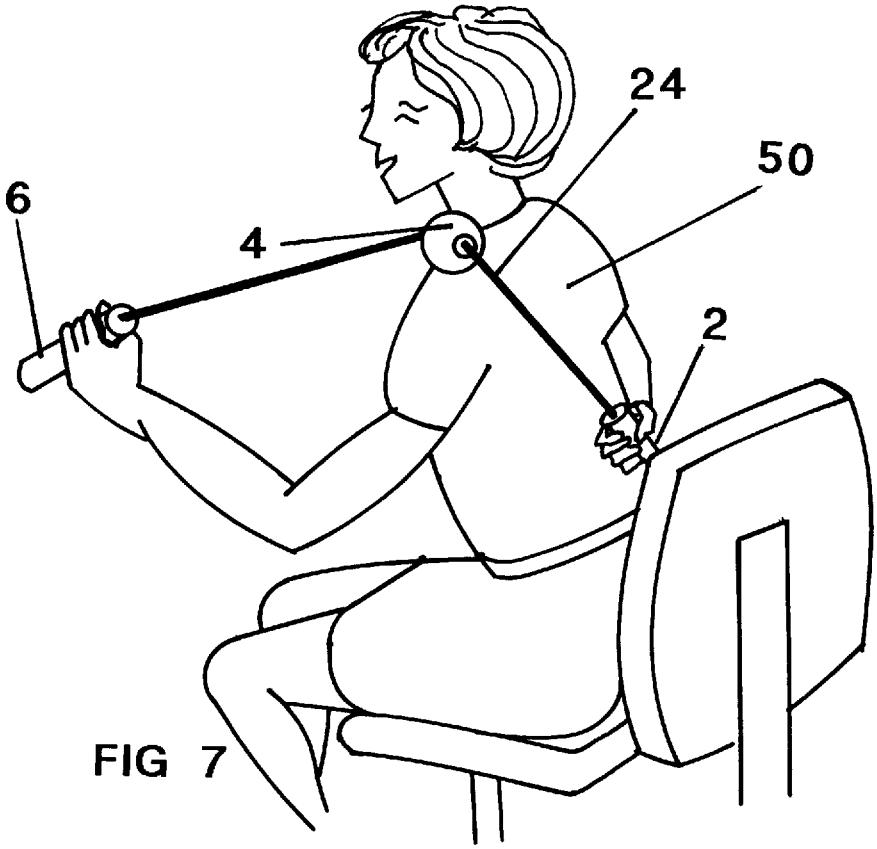
FIG. 7 is a perspective view of a person massaging her shoulder using the present invention.
Figure 8:
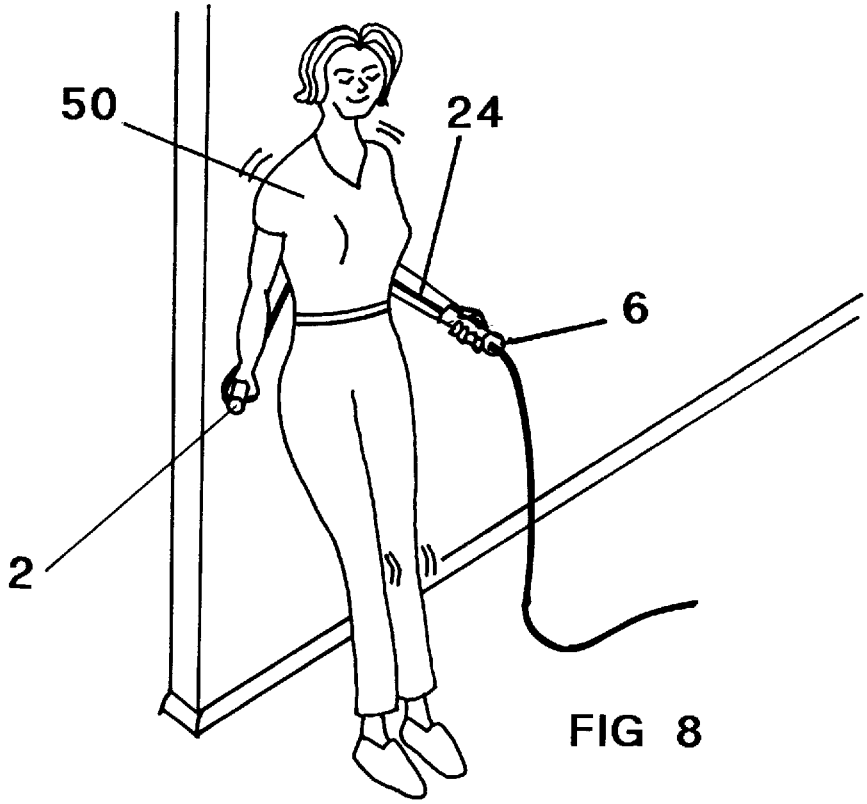
FIG. 8 is a perspective view of a person massaging her back while leaning against a wall using the present invention.
Figure 9:
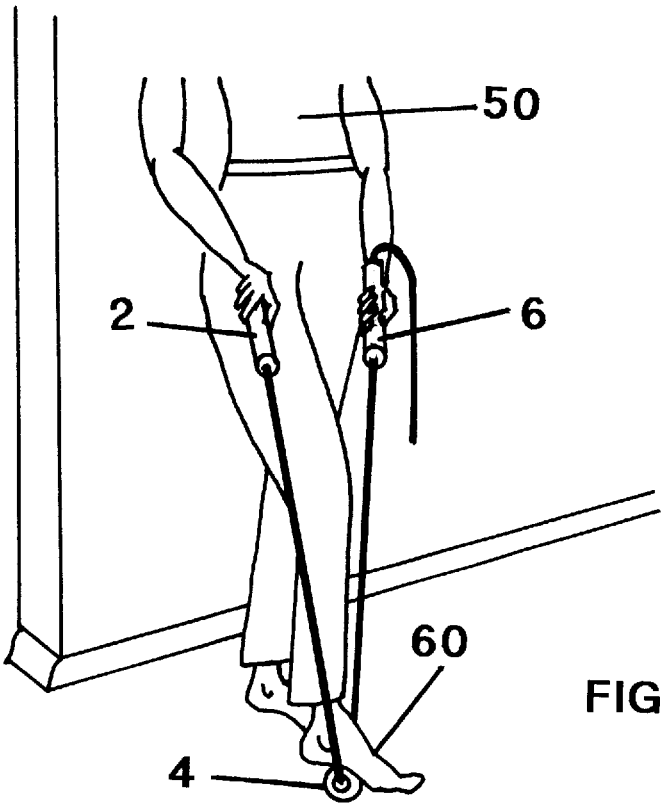
FIG. 9 is a perspective view of a person massaging her foot using the present invention.
Figure 10:
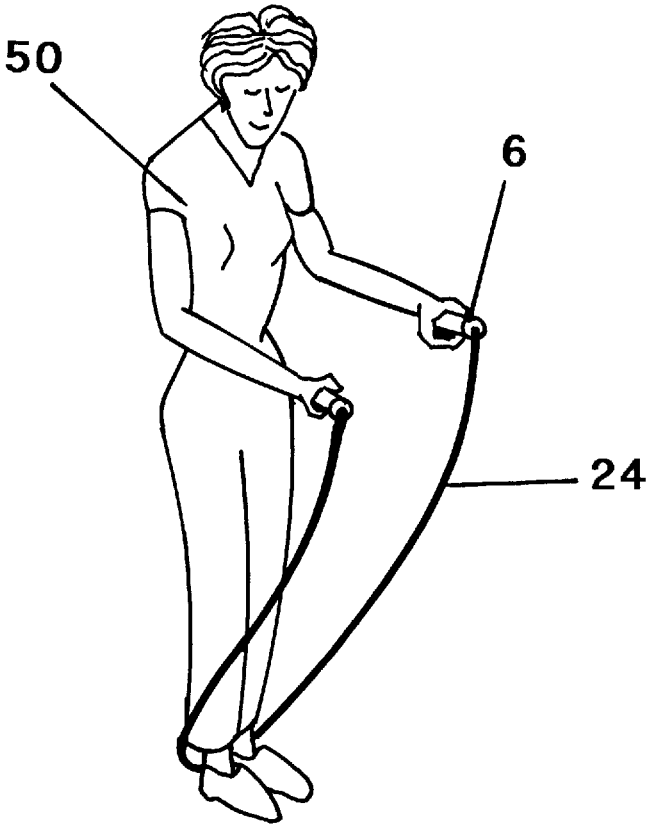
FIG. 10 is a perspective view of a person using the present invention as a jump rope.

Referring now to FIG. 1 we see a person 50 holding handles 2, 6 of the present invention with a rollable hard rubber ball 4 trapped between the handles 2,6. Resilient cord 24 starts in handle 2 and runs through ball 24 and through handle 6 and continues out beyond handle 6 for about nine feet. The user 50 is massaging her thigh in much the same way that other hand held massagers work. This configuration is adequate for easy to reach places such as the thigh but becomes unworkable when the user is giving a self massage to a hard to reach area such as the back or the sole of the foot. FIG. 2 shows a section view of the present invention. Handle 2 consists of a rigid injection molded plastic cylindrical core 10 having a softer neoprene gripping surface 12 surrounding the core 10. A hollow portion at the left end of handle 2 houses a resilient plastic cord 24 which is about five sixteenths of an inch in diameter and can be made of flexible vinyl. The cord end 25 is captured by retaining washer 14 which is permanently affixed to the cord end 25 thereby preventing the cord from being removed from the handle 2. The hollow portion of handle 2 is large enough to allow retaining washer 14 and cord 24 to turn freely. Ball bearing 16 is located at the exit point of the hollow portion of handle 2 thereby allowing easy turning of cord 24 when the present invention is being used. Hard rubber ball 4 is about a 60 durometer hardness although other embodiments could use harder or softer balls. Ball bearings 18, 23 are inserted at either end of the hollow shaft 21 running longitudinally through the center of ball 4 thereby allowing ball 4 to turn freely about cord 24 which passes through the center of the ball 4. Rubber O rings 18, 22 impinge upon cord 24 and help the ball 4 to stay in position along cord 24. However ball 4 can be easily repositioned along the length of cord 24 by rolling the O rings 18, 22 to the left or right trapping ball 4 in-between them yet allowing ball 4 to rotate freely about cord 24. Handle 6 is designed in a similar fashion to handle 2, however bearing 26 is at the left side of handle 6 and cord 24 runs throughout the handle and exits the right side and proceeds for a distance of about nine feet (not shown) retaining ring assembly 8, shown in cross section in FIG. 3 is located just beyond the right end of handle 6. The ring 38 has a centrally located hole which is slidably engaged with cord 24. The tip of pin 40 is forcefully engaged with cord 24 by means of a compression spring 36 which surrounds pin 40 and presses on a flange 41 integral to pin 40. Cap 43 retaining spring 36 at its upper most part. To loosen the retaining ring the user pulls on the ball shaped handle 32 located on top of and integral to pin 40 thereby removing the impinging effect of pin 40 on cord 24. The retaining ring can then be slid by the user to a different location on the cord 24 which will be most comfortable for the massage being performed on a particular part of the users body at that time. The retaining ring assembly 8 may take other forms such as a spring metal clamp or a similarly designed spring loaded pin as shown in FIG.3 but built integrally into handle 6. FIG. 4 shows a person 50 using the hand held massager of the present invention. By exerting forward pressure on handles 2 and 6 the user can cause a massaging action where the hard rubber ball 4 meets the users body. The user 50 can alternately pull handle 2 then handle 6 creating a side to side massaging action or the user 50 can lift alternately lift and lower handles 2 and 6 thereby creating an up and down massaging action. The user 50 can also position the massage ball 4 on his or her back and then lean back into a chair 49 causing the rubber ball 4 to be sandwiched between the users back and the chair back 49. While in this position the user 50 can move his or her back slightly to the right or left, or up and down while applying pressure by leaning back in the chair resulting in a deep tissue massage at the affected area. FIG. 6 shows a person using the hand held massager of the present invention to give herself a neck massage. FIG. 7 shows a person using the hand held massager of the present invention to give herself a shoulder massage. FIG. 8 shows a person 50 massaging her back with the hand held massager of the present invention while providing additional massaging pressure by leaning against a wall thereby sandwiching the massage ball between her back and the stationary wall. FIG. 9 shows the user giving herself a foot massage using the hand held massager of the present invention. The users foot 60 can roll over the hard rubber massage ball 4 and the user can decide how much pressure to apply from her foot 60 and associated body weight onto the massage ball 4. FIG. 10 shows that the hand held massage device of the present invention can also be used as a jump rope by extending handle 6 to the maximum outward position thereby making approximately ten feet of cord 24 available for the jump rope activity.

Although the above drawings and description of drawings show a preferred embodiment of the hand held massage of the present invention it is understood that there may be other embodiments which are not shown or described but which would be obvious to one versed in the art of hand held massagers and therefore included within the spirit and scope of the present invention.

Therefore we claim:

1. A hand held massaging device comprised of a first and second handle, a resilient ball, a flexible cord approximately five sixteenths inch in diameter and ten feet long and a restraining ring, said first handle having a rigid cylindrical core portion and having located at the left end an axially oriented hollow cavity capable of retaining an axially oriented ball bearing through which said flexible cord passes out said left side, said cord being restricted from totally exiting said ball bearing by a retaining washer located on the opposite side of said ball bearing, said first handle having a resilient outer wrap forming a gripping portion, said resilient ball having a centrally located hollow shaft portion terminating at each end in a right and left ball bearing assembly, said flexible cord exiting said first handle and slidably entering and exiting through said right and left ball bearings of said resilient ball, said flexible cord entering said second handle, said second handle having a rigid core, said core having an axially oriented hollow portion running the entire length of said second handle, said hollow portion having an enlarged hollow section at the right end capable of retaining a ball bearing for said resilient cord to penetrate, said flexible cord exiting the left end of said second handle so that said second handle can both rotate and slide on said flexible cord, said second handle having a resilient grip portion surrounding said rigid core, said retaining ring located at the left cord exit point of said second handle, said retaining ring capable of being released and slid down the length of said flexible cord thereby preventing said second handle from sliding beyond the limit set by said retaining ring.

2. A hand held massaging device as claimed in claim 1 wherein said resilient ball can be temporarily restricted from traveling to the right or left while slidably and ratably mounted on said flexible cord by means of a right and left O ring which frictionally impinges on the circumference of said flexible cord thereby allowing the user to select and fix said resilient ball at any desired location on said flexible cord.

3. A hand held massaging device as claimed in claim 1 wherein said retaining ring consists of a rigid cylindrical portion having an axially located hole penetrating completely said cylindrical portion capable of allowing said flexible cord to slidably pass through, said cylindrical portion having a hole at right angles to said axial hole and penetrating said axial hole, said right angle hole having a spring loaded pin captured within it so that said pin impinges on said flexible cord causing said retaining ring to be temporarily affixed until a user retracts said spring loaded pin so that said ring is free to slide on said flexible cord.

* * * * *